US007895809B2

(12) United States Patent
Wolfe

(10) Patent No.: US 7,895,809 B2
(45) Date of Patent: Mar. 1, 2011

(54) SUPPORT BEAM AND ATTACHMENT CLEVIS ASSEMBLY

(75) Inventor: Ronald D. Wolfe, Wichita, KS (US)

(73) Assignee: Wolfe Electric, Inc., Wichita, KS (US)

( * ) Notice: Subject to any disclaimer, the term of this patent is extended or adjusted under 35 U.S.C. 154(b) by 603 days.

(21) Appl. No.: 11/535,290

(22) Filed: Sep. 26, 2006

(65) Prior Publication Data

US 2008/0072528 A1 Mar. 27, 2008

(51) Int. Cl.
*E04C 3/02* (2006.01)
*E04C 2/08* (2006.01)

(52) U.S. Cl. ..... 52/831; 52/843; 52/846; 52/781

(58) Field of Classification Search ..... 52/831, 52/843, 836, 844, 846, 781, 761, 235, 299
See application file for complete search history.

(56) References Cited

U.S. PATENT DOCUMENTS 1,330,370 A 2/1920 Davis
1,643,577 A * 9/1927 Dornier ..... 52/843
1,975,228 A * 10/1934 Grumman ..... 52/838
1,997,876 A * 4/1935 Sheldon ..... 52/839
2,050,609 A * 8/1936 Howell ..... 52/352
2,753,601 A * 7/1956 Brunton ..... 52/843
2,950,789 A 8/1960 Davis, Jr.
2,975,874 A * 3/1961 Pagan ..... 138/163
2,990,922 A * 7/1961 Rudisill ..... 52/656.2
3,222,841 A * 12/1965 Lipof ..... 52/482
3,332,197 A * 7/1967 Hinkle ..... 52/844
3,420,032 A * 1/1969 Felt ..... 52/844
3,596,427 A * 8/1971 Fernandez et al. ..... 52/282.4
3,601,946 A * 8/1971 Rothemund ..... 52/844
3,611,666 A * 10/1971 Poyser et al. ..... 52/844
3,694,990 A * 10/1972 Pamer ..... 52/839
3,827,740 A * 8/1974 Golze et al. ..... 293/120
3,907,356 A * 9/1975 Sien ..... 296/204
4,001,993 A * 1/1977 Daniels ..... 52/376
4,069,638 A * 1/1978 Hasselqvist et al. ..... 52/843
4,122,647 A * 10/1978 Kovar ..... 52/695
4,171,598 A * 10/1979 Holmes ..... 52/118
D273,334 S 4/1984 Young
4,512,129 A * 4/1985 Riggs ..... 52/364
4,720,957 A 1/1988 Madray
4,760,682 A * 8/1988 King ..... 52/844
4,905,442 A * 3/1990 Daniels ..... 52/588.1
4,987,717 A * 1/1991 Dameron, Jr. ..... 52/844
4,993,095 A * 2/1991 Lautensleger et al. ..... 14/74.5
5,154,029 A * 10/1992 Sturgeon ..... 52/235
5,442,885 A 8/1995 Laven et al.
5,881,514 A 3/1999 Pryor (Continued)

*Primary Examiner*—Phi Dieu Tran A
(74) *Attorney, Agent, or Firm*—Kenneth H. Jack; Davis & Jack, L.L.C.

(57) ABSTRACT

A support beam and attachment clevis assembly having a pair of "J" beams, each "J" beam having a stem and a tail, each "J" beam's tail having a distal end and a longitudinal extension, each "J" beam's stem having an upper end and a longitudinal extension, the longitudinal extension of each "J" beam's stem being greater than that of said each "J" beam's tail; and incorporating a plurality of blind rivets interconnecting the pair of "J" beams so that the distal end of each "J" beam's tail contacts the upper end of the other "J" beam's stem.

7 Claims, 3 Drawing Sheets

U.S. PATENT DOCUMENTS

| | | | | |
|---|---|---|---|---|
| 6,374,554 | B1 | 4/2002 | Eungard | |
| 6,385,941 | B1 * | 5/2002 | Power et al. | 52/844 |
| 6,802,170 | B2 | 10/2004 | Davis | |
| 7,155,874 | B2 * | 1/2007 | Lee | 52/843 |
| 2002/0116891 | A1 | 8/2002 | Waldrop | |
| 2003/0009977 | A1 | 1/2003 | Houghton | |
| 2003/0084629 | A1 | 5/2003 | Strickland et al. | |
| 2004/0118072 | A1 | 6/2004 | Collins | |

* cited by examiner

SUPPORT BEAM AND ATTACHMENT CLEVIS ASSEMBLY

FIELD OF THE INVENTION

This invention relates to structural beams and means for interconnecting structural beam ends to other structural members.

BACKGROUND OF THE INVENTION

Structural beam and clevis attachment assemblies are known. However, such assemblies typically undesirably require the provision of separate clevis mount assemblies in addition to a longitudinally extending structural beam, or undesirably require ends of a structural beam to be cast or molded to includes clevis mounting arms or ears.

The instant inventive support beam and attachment clevis assembly overcomes the drawbacks and defects set forth above by providing a pair of "J" beams and "J" beam fastening means which economically and with mechanical simplicity create a functional and durable support beam having clevis mounts at either end.

BRIEF SUMMARY OF THE INVENTION

A first structural component of the instant inventive support beam and attachment clevis assembly comprises a pair of "J" beams, each "J" beam having a stem and a tail. Each "J" beam's tail preferably has a distal end and a longitudinal extension, and each "J" beam's stem preferably has an upper end and a longitudinal extension. The longitudinal extension of each "J" beam's stem is preferably greater than that of said each "J" beam's tail.

A further structural component of the instant inventive support beam and attachment clevis assembly comprises fastening means. Preferably, the fastening means rigidly interconnects the pair of "J" beams so that the distal end of each "J" beam's tail contacts and cleaves to the upper end of the other "J" beam's stem.

Preferably, the fastening means comprises a plurality of blind rivets or pop rivets. Other fastening means which may be suitably used in place of the preferred blind rivets comprise sheet metal screws, helically threaded nut and bolt combinations, helically threaded screw and sheet metal aperture combinations, heat fusion welds, and adhesive bonds.

Where the fastening means comprises blind rivets, as preferred, the fastening preferably further comprises a quadruple of longitudinal aperture series, each aperture series among the quadruple of longitudinal aperture series preferably being arranged substantially identically with each other aperture series among said quadruple of series. Preferably, each aperture among the quadruple of longitudinal aperture series extends laterally through one of the "J" beams. Upon provision of such substantially identical longitudinal aperture series, and upon positioning of the pair of "J" beams so that the distal end of each "J" beam's tail contacts the upper end of the other "J" beam's stem, such aperture series may beneficially align with each other to allow a plurality of blind rivet fasteners to be extended therethrough for rigidly attaching the "J" beams to each other.

Upon such attachment, the "J" beam's stems excess longitudinal extensions may beneficially further function as ears of clevises. Preferably, such clevis ears are further identically apertured in a quadruple of clevis aperture series. The quadruple of clevis aperture series beneficially function for attachment of their devises to other structural members.

The instant inventive assembly is particularly amenable to mass production with materials and production steps economies resulting from repetitions of two basic parts, then being the "J" beam and the blind fastener.

Accordingly, objects of the instant invention include the provision of a support beam and attachment clevis assembly comprising identical multiples of components, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 2:
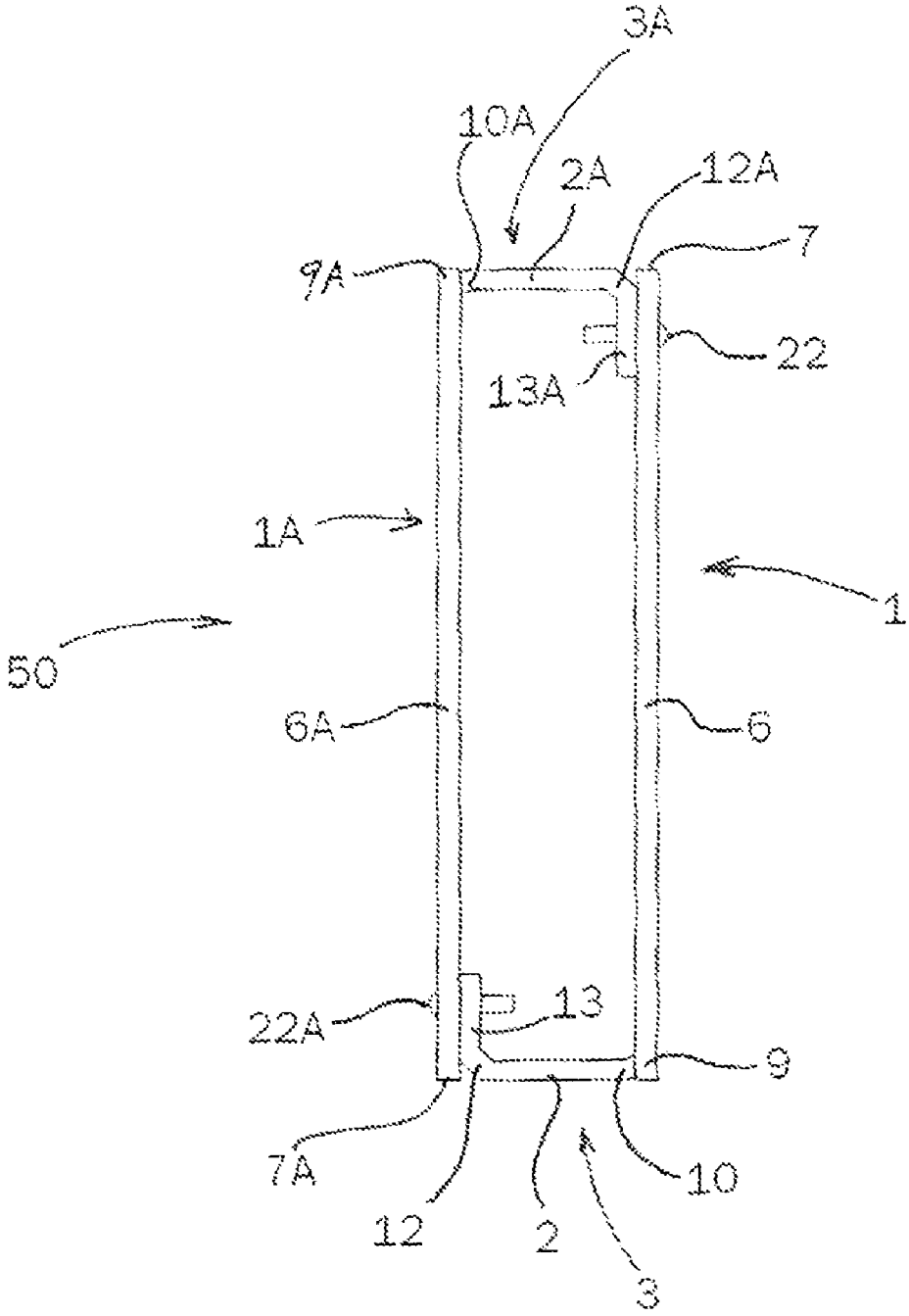
FIG. 2 is an end view of the instant inventive support beam and attachment clevis assembly.
Figure 3:
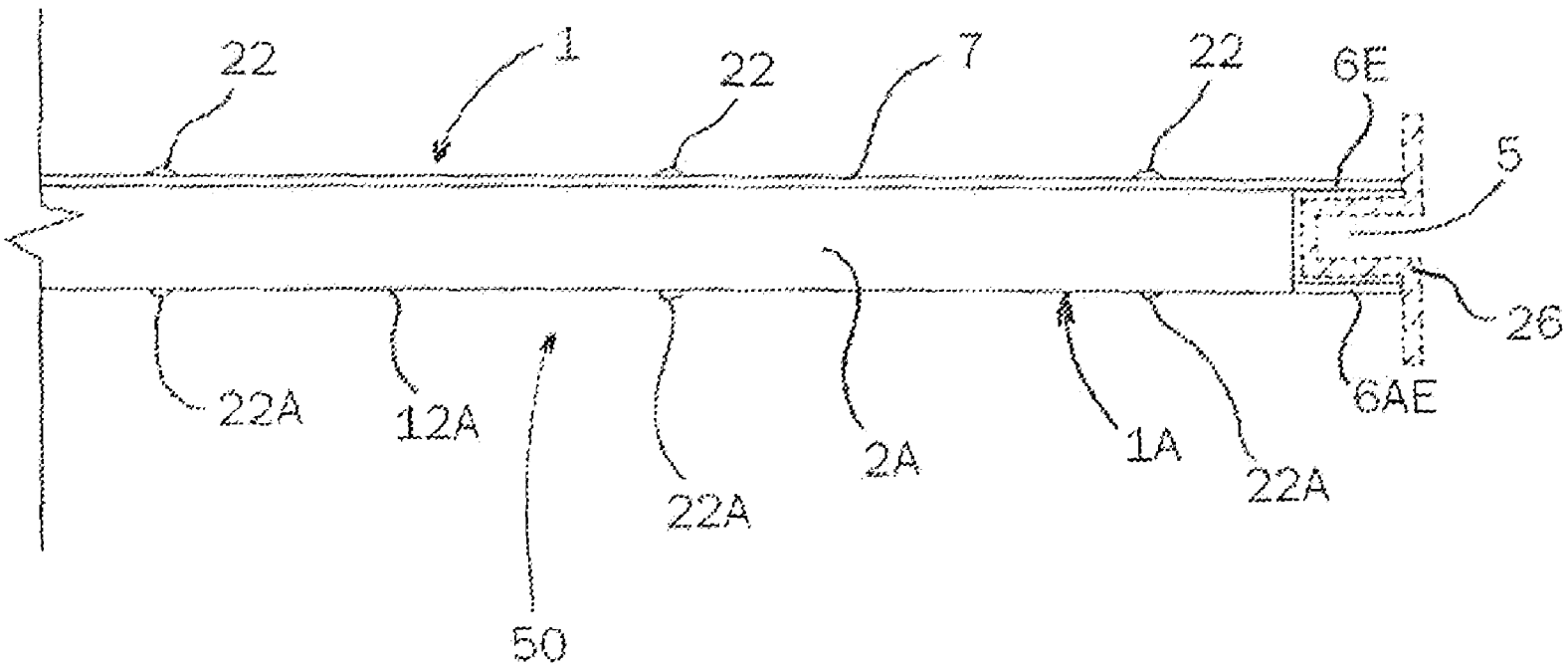
FIG. 3 is a partial upper plan view of the instant inventive support beam and attachment clevis assembly, the view further representationally depicting in dashed lines a clevis mounted "hat" beam.

Referring simultaneously to FIGS. 2 and 3, a preferred embodiment of the instant inventive support beam and attachment clevis assembly is referred to generally by Reference Arrow 50. The assembly 50 preferably comprises a pair of "J" beams which are referred to generally by Reference Arrows 1 and 1A.

Referring to FIG. 2, the first "J" beam 1 has a stem 6, the stem 6 having an upper end 7 and having a lower end 9. The "J" beam 1 preferably further comprises a tail which is referred to generally by Reference Arrow 3. The tail 3 preferably comprises a web section 2 and a distal attachment flange section 13. Preferably, a pair of 90° bends 10 and 12 span between and respectively interconnect the lower end 9 of the stem 6 of the "J" beam 1 with the proximal end of the web section 2 of the tail 3, and interconnect the tail's distal attachment flange section 13 with the distal end of the web section 2.

Referring further to FIG. 2, the remaining "J" beam 1A among the pair of "J" beams is preferably configured substantially identically with the first "J" beam 1. All reference numerals associated with "J" beam 1A having a suffix "A" identify structures which are preferably configured substantially identically with similarly numbered structures of "J" beam 1.

Figure 1:
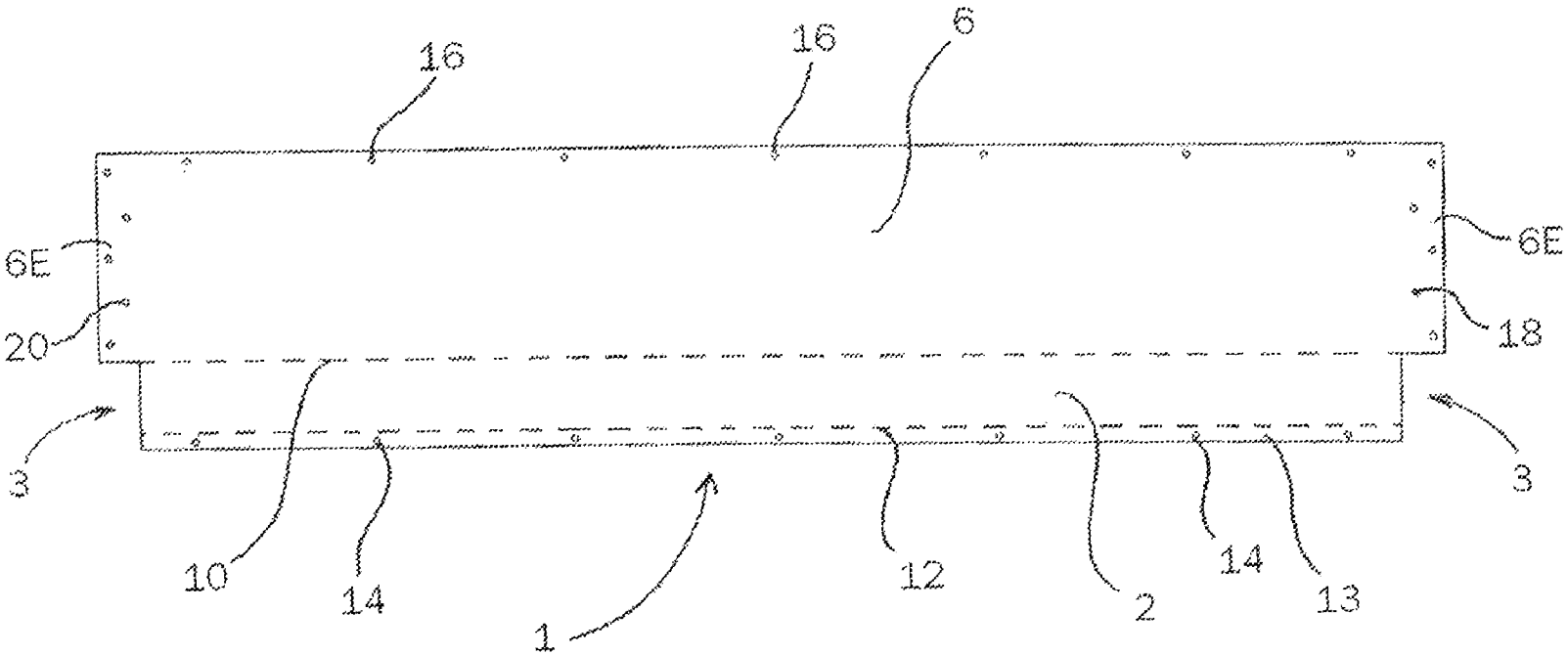
FIG. 1 is a plan view of a preliminary configuration by one of the "J" beam components of the instant inventive support beam and attachment clevis assembly.

Referring simultaneously to FIGS. 1 and 2, longitudinally extending dashed lines 10 and 12 are locationally representative of the 90° bends 10 and 12 appearing on FIG. 2. The "J" beam 1, as depicted in FIG. 1, preferably is initially configured as a flat plate of sheet steel. Both the stem 6 and the tail 3 of the "J" beam 1, have a longitudinal extension extending in the left/right direction according to the view of FIG. 1. The longitudinal extension of the stem 6 is greater than that of the tail 3, the excess extension portions of the stem 6 being designated by Reference Numerals 6E. Preferably, the left and right longitudinal extensions of the stem 6 extend equidistantly beyond the longitudinal left and right ends of the tail 3. Though the second flat plate which is preferably similarly formed to produce the second "J" beam 1A is not depicted in FIG. 1, such second flat plate is preferably configured substantially identically with the flat plate depicted in FIG. 1.

Referring simultaneously to FIGS. 1 and 2, the depicted bent plate formation of the "J" beams 1 and 1A is preferred. However, "J" beams 1 and 1A in their "J" configuration as depicted in FIG. 2 are intended as being additionally representative of metal or plastic extrusions. Where the "J" beams are alternately extruded, the requisite excess left and right longitudinal extensions of the stem 6 are preferably produced by notch cutting of the tail 3 to shorten its longitudinal extension and to cause the stem 6 to present clevis mounting extensions.

Referring further simultaneously to FIGS. 1 and 2, fastening means are necessarily provided. The fastening means preferably position and interconnect the "J" beams 1 and 1A so that the distal ends of their tails 3 and 3A respectively contact and cleave to the upper ends 7A and 7 of the stems 6A and 6 of "J" beams 1A and 1.

In the preferred embodiment of the inventive support beam and attachment clevis assembly, the fastening means comprise a quadruple of longitudinal aperture series. Referring to FIG. 1, laterally extending apertures 14 constitute a first such longitudinal aperture series among the preferred quadruple of aperture series. Similarly, laterally extending apertures 16 constitute a second such aperture series. The third and fourth longitudinal aperture series among the quadruple preferably extend through "J" beam 1A. As shown in FIG. 1, each of the aperture series among the quadruple of longitudinal aperture series is preferably arranged substantially identically with each other longitudinal aperture series. Such substantially identical arrangement of series beneficially permits an orientation of "J" beams 1 and 1A, as depicted in FIG. 2, wherein the longitudinal aperture series positioned at the distal attachment flange section 13 of the tail 3 aligns with longitudinal aperture series positioned at the upper end of the stem 6A of "J" beam 1A.

Referring to FIGS. 1 and 2, the longitudinal aperture series positioned at the upper ends of the stems 6 and 6A of "J" beams 1 and 1A constitute a first pair of aperture series among the preferred quadruple of longitudinal aperture series, and the longitudinal aperture series extending through the distal or attachment flange ends 13 and 13A of tails 3 and 3A constitute the remaining pair of aperture series among said quadruple of series. The fastening means which interconnect the pair of "J" beams 1 and 1A preferably further comprises a plurality of blind rivets 20 and 22A, each blind rivet among the plurality of blind rivets 22 and 22A extending through both one of the apertures among the first pair of longitudinal aperture series and through one of the apertures among the remaining pair of longitudinal aperture series. The inverted alignments of longitudinal aperture series within the stems 6 and 6A and tails 3 and 3A of the "J" beams 1 and 1A advantageously facilitates such utilization of such blind rivets as the fastening means. Notwithstanding, the blind rivets 22 and 22A are intended as being additionally representative of sheet metal screws and other commonly known sheet material fastening means.

Referring simultaneously to all figures, extensions 6E and 6AE respectively extend longitudinally from the stems 6 and 6A of the "J" beams 1 and 1A, such extensions advantageously functioning as ears of clevis mount joints, such joints defining clevis mounting spaces 5. The mounting spaces 5 may advantageously receive a "U" portion of an exemplary perpendicularly extending "hat" beam 26, such hat beam 26 being representationally depicted in dashed lines.

Referring further simultaneously to all figures, in order to facilitate clevis mounted attachments of structures such as hat beam 26 to the clevis formed ends of the assembly 50, a quadruple of clevis aperture series extending laterally through the "J" beams are preferably provided, each clevis aperture series among said quadruple preferably being positioned at an extreme longitudinal extension 6E or 6AE of the stem of one of the "J" beams.

Referring in particular to FIG. 1, laterally extending aperture series 18 and 20 which are respectively positioned at longitudinal extension sections 6E represent a first pair of clevis aperture series among the preferred quadruple of clevis aperture series. Referring further to FIGS. 2 and 3, the remaining pair of clevis aperture series extend through the longitudinal extension sections 6AE of the stem 6A of the "J" beam 1A, preferably substantially identically with the aperture series arrangements depicted in FIG. 1. Each of the apertures among the quadruple of clevis aperture series may receive fasteners such as rivets, screws, or bolts (none depicted) for rigidly fastening the inventive assembly 50 to structures such as hat beam 26.

Among numerous other uses and functions commonly serve by support beams, the instant inventive assembly may advantageously serve as a trailer load bed floor joist whose longitudinal ends are readily attachable to vertically extending wall studs.

While the principles of the invention have been made clear in the above described illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A support beam and attachment clevis assembly comprising:

(a) a pair of substantially identically configured "J" beams, each "J" beam having a substantially planar stem and a tail, each "J" beam's tail having a distal end and a longitudinal extension, each "J" beam's stem having an upper end lying substantially within said each "J" beam's plane and a longitudinal extension, the stem and tail of each "J" beam among the pair of substantially identically configured "J" beams having an extension differential wherein the longitudinal extension of said each "J" beam's stem is greater than that of said each "J" beam's tail, the extension differentials defining an unobstructed attachment clevis; and (b) fastening means interconnecting the pair of "J" beams so that the distal end of each "J" beam's tail contacts the upper end of the other "J" beam's stem;

wherein the fastening means comprises a quadruple of longitudinal aperture series, each longitudinal aperture series among the quadruple of longitudinal aperture series being arranged substantially identically with each other longitudinal aperture series among said quadruple, each aperture among the quadruple of longitudinal aperture series extending laterally through one of the "J" beams.

2. The support beam and attachment clevis assembly of claim 1 wherein a first pair of longitudinal aperture series among the quadruple of longitudinal aperture series are positioned at the upper ends of the "J" beams' stems, and wherein the remaining pair of longitudinal aperture series among the quadruple of longitudinal aperture series are positioned at the distal ends of the "J" beams' tails.

3. The support beam and attachment clevis assembly of claim 2 wherein the fastening means further comprises a plurality of blind rivets, each blind rivet extending both through one of the apertures among the first pair of longitudinal aperture series and through one of the apertures among the remaining pair of longitudinal aperture series.

4. The support beam and attachment clevis assembly of claim 3 further comprising a quadruple of clevis aperture series, each clevis aperture series extending laterally through one of the "J" beams and being positioned at a longitudinal end of said one "J" beam's stem.

5. The support beam and attachment clevis assembly of claim 4 wherein each aperture series among the quadruple of clevis aperture series is arranged substantially identically with each other aperture series among the quadruple of clevis aperture series.

6. The support beam and attachment clevis assembly of claim 4 wherein each "J" beam's tail comprises a laterally extending web section, and an attachment flange section.

7. The support beam and attachment clevis assembly of claim 6 wherein each "J" beam further comprises a pair of 90° bends, a first 90° bend among the pair of 90° bends spanning between said each "J" beam's stem and said each "J" beam's tail's web section, and the remaining 90° bend spanning between said each "J" beam's tail's web section and said each "J" beam's tail's attachment flange section.

* * * * *